US009308718B2

(12) United States Patent
Fujinaga

(10) Patent No.: US 9,308,718 B2
(45) Date of Patent: Apr. 12, 2016

(54) PRINTING APPARARUS AND PRINTING CONTROL METHOD

(71) Applicant: CANON KABUSHIKI KAISHA, Tokyo (JP)

(72) Inventor: Seiya Fujinaga, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 147 days.

(21) Appl. No.: 13/955,036

(22) Filed: Jul. 31, 2013

(65) Prior Publication Data

US 2015/0035882 A1 Feb. 5, 2015

(30) Foreign Application Priority Data

Jul. 31, 2012 (JP) ..... 2012-169451

(51) Int. Cl.
*B41J 2/045* (2006.01)
*B41M 5/00* (2006.01)
*B41J 3/60* (2006.01)

(52) U.S. Cl.
CPC ..... *B41J 2/04501* (2013.01); *B41J 3/60* (2013.01); *B41M 5/00* (2013.01)

(58) Field of Classification Search
CPC ..... B41J 2/04501; B41J 2/0458; B41J 29/38; B41J 2/04541; B41J 11/007; B41M 5/00; G06K 15/1867; G06K 15/1868; G06K 15/022
USPC ..... 347/5, 9, 14, 101, 104; 358/1.15, 1.18
See application file for complete search history.

(56) References Cited

U.S. PATENT DOCUMENTS

| | | | |
|---|---|---|---|
| 4,268,943 | A | 5/1981 | Watanabe et al. |
| 4,317,270 | A | 3/1982 | Watanabe et al. |
| 5,532,799 | A | 7/1996 | Watanabe et al. |
| 5,915,146 | A | 6/1999 | Kusaka et al. |
| 6,179,287 | B1 | 1/2001 | Watanabe et al. |
| 6,240,263 | B1 | 5/2001 | Watanabe et al. |

(Continued)

FOREIGN PATENT DOCUMENTS

| | | |
|---|---|---|
| JP | H03-197140 | 8/1991 |
| JP | 2002-046260 | 2/2002 |

(Continued)

OTHER PUBLICATIONS

U.S. Appl. No. 13/955,051, Jul. 31, 2013, Not Yet Assigned, Yuichiro Araki.

(Continued)

*Primary Examiner* — An Do
(74) *Attorney, Agent, or Firm* — Fitzpatrick, Cella, Harper & Scinto

(57) ABSTRACT

There is provided a method for appropriately coping with a case where a unique portion of a sheet is detected at the time of performing printing on a second surface of the sheet in both-side printing. If the unique portion position end mark is detected and it is determined that it is on the other side surface of the sheet, a length of the unique portion area is calculated. In addition, among images that are already printed by the printing onto the one side surface of the sheet, an image on the one side surface of the sheet corresponding to the calculated unique portion area is detected. Next, a group of the detected image on the one side surface and the image on the other side surface corresponding to the detected image are extracted as reprint data, which is stored in a predetermined memory.

14 Claims, 17 Drawing Sheets

(56) References Cited

U.S. PATENT DOCUMENTS

| | | | | |
|---|---|---|---|---|
| 6,575,546 | B2 | 6/2003 | Matsumoto et al. | |
| 7,050,751 | B2 | 5/2006 | Watanabe et al. | |
| 2008/0159800 | A1* | 7/2008 | Wada | 400/621 |
| 2011/0141181 | A1* | 6/2011 | Ito et al. | 347/16 |
| 2011/0211008 | A1* | 9/2011 | Teshigawara et al. | 347/16 |
| 2011/0279508 | A1 | 11/2011 | Naito | |
| 2011/0310151 | A1* | 12/2011 | Serizawa | 347/14 |
| 2013/0088541 | A1 | 4/2013 | Naito | |

FOREIGN PATENT DOCUMENTS

| | | |
|---|---|---|
| JP | 2003-237157 | 8/2003 |
| JP | 4278885 | 6/2009 |
| JP | 2011-240492 | 12/2011 |
| JP | 2011-240493 | 12/2011 |

OTHER PUBLICATIONS

U.S. Appl. No. 13/955,072, Jul. 31, 2013, Not Yet Assigned, Hiroaki Hasegawa.
U.S. Appl. No. 13/955,032, Jul. 31, 2013, Not Yet Assigned, Minako Adachi.
U.S. Appl. No. 13/955,040, Jul. 31, 2013, Not Yet Assigned, Norio Shimura.
U.S. Appl. No. 13/955,045, Jul. 31, 2013, Not Yet Assigned, Taketomo Naruse.
U.S. Appl. No. 13/955,057, Jul. 31, 2013, Not Yet Assigned, Taketoshi Kusakabe.
U.S. Appl. No. 13/955,060, Jul. 31, 2013, Not Yet Assigned, Taketomo Naruse.
U.S. Appl. No. 13/955,068, Jul. 31, 2013, Not Yet Assigned, Tatsuya Fukuda.

* cited by examiner

| | PRINT JOB | | | JOB CONTROL INFORMATION | | |
|---|---|---|---|---|---|---|
| PRINT WAITING JOB LIST | PRINT SHEET SIZE | SHEET KIND | PRINT DATA | PRINTABLE ROLL WIDTH SIZE [inch] | PRINT ROLL WIDTH SIZE [inch] | STATUS |
| No.1 | 4×6 | A | xxx.jpg ... | 6 | | DURING RECEPTION PROCESSING |
| No.2 | 6×8 | A | xxx.jpg ... | 6/8 | | DURING RECEPTION PROCESSING |
| No.3 | 4×6 | A | xxx.jpg ... | 6 | | DURING RECEPTION PROCESSING |
| No.4 | 4×6 | B | xxx.jpg ... | 6 | | DURING RECEPTION PROCESSING |
| No.5 | 6×12 | A | xxx.jpg ... | 6/12 | | DURING RECEPTION PROCESSING |
| No.6 | 5×8 | A | xxx.jpg ... | 8 | | DURING RECEPTION PROCESSING |
| No.7 | 4×6 | A | xxx.jpg ... | 6 | | DURING RECEPTION PROCESSING |
| No.8 | 6×8 | A | xxx.jpg ... | 6/8 | | DURING RECEPTION PROCESSING |

FIG.11A

| | PRINTING JOB | | | JOB CONTROL INFORMATION | | |
|---|---|---|---|---|---|---|
| PRINT WAITING JOB LIST | PRINT SHEET SIZE | SHEET KIND | PRINT DATA | PRINTABLE ROLL WIDTH SIZE [inch] | PRINT ROLL WIDTH SIZE [inch] | STATUS |
| No.1 | 4×6 | A | xxx.jpg | 6 | | PRINTING FINISH |
| No.2 | 6×8 | A | xxx.jpg | 6/8 | | PRINTING FINISH |
| No.3 | 4×6 | A | xxx.jpg | 6 | | PRINTING FINISH |
| No.4 | 4×6 | B | xxx.jpg | 6 | | PRINTING FINISH REPRINTING EXISTS |
| No.5 | 6×12 | A | xxx.jpg | 6/12 | | DURING PRINTING |
| No.6 | 5×8 | A | xxx.jpg | 8 | | DURING PRINTING |
| No.7 | 4×6 | A | xxx.jpg | 6 | | DURING RECEPTION PROCESSING |
| No.8 | 6×8 | A | xxx.jpg | 6/8 | | DURING RECEPTION PROCESSING |

FIG.11B

| | PRINTING JOB | | | JOB CONTROL INFORMATION | | |
|---|---|---|---|---|---|---|
| PRINT WAITING JOB LIST | PRINT SHEET SIZE | SHEET KIND | PRINT DATA | PRINTABLE ROLL WIDTH SIZE [inch] | PRINT ROLL WIDTH SIZE [inch] | STATUS |
| No.1 | 4×6 | A | xxx.jpg | 6 | | PRINTING FINISH |
| No.2 | 6×8 | A | xxx.jpg | 6/8 | | PRINTING FINISH |
| No.3 | 4×6 | A | xxx.jpg | 6 | | PRINTING FINISH |
| No.4 | 4×6 | B | xxx.jpg | 6 | | PRINTING FINISH REPRINTING FINISH |
| No.5 | 6×12 | A | xxx.jpg | 6/12 | | PRINTING FINISH |
| No.6 | 5×8 | A | xxx.jpg | 8 | | DURING PRINTING |
| No.7 | 4×6 | A | xxx.jpg | 6 | | DURING RECEPTION PROCESSING |
| No.8 | 6×8 | A | xxx.jpg | 6/8 | | DURING RECEPTION PROCESSING |

FIG.11C

FIG.12A

| | |
|---|---|
| No.1 | PRINTING FINISH |
| No.2 | PRINTING FINISH |
| No.3 | DURING PRINTING |
| No.4 | PRINT WAITING |
| No.5 | PRINT WAITING |

| PRINT ORDER |
|---|
| No.3 |
| No.4 |
| No.5 |

FIG.12B

| | |
|---|---|
| No.1 | PRINTING FINISH |
| No.2 | PRINTING FINISH |
| No.3 | PRINTING FINISH REPRINTING EXISTS |
| No.4 | DURING PRINTING |
| No.5 | PRINT WAITING |

| PRINT ORDER |
|---|
| No.4 |
| No.5 |
| REPRINTING OF NO. 3 |

FIG.12C

| | |
|---|---|
| No.1 | PRINTING FINISH |
| No.2 | PRINTING FINISH |
| No.3 | PRINTING FINISH DURING REPRINTING |
| No.4 | DURING PRINTING |
| No.5 | PRINT WAITING |

| PRINT ORDER |
|---|
| No.4 |
| REPRINTING OF NO. 3 |
| No.5 |

FIG.12D

| | |
|---|---|
| No.1 | PRINTING FINISH |
| No.2 | PRINTING FINISH |
| No.3 | PRINTING FINISH DURING REPRINTING |
| No.4 | PRINTING FINISH |
| No.5 | PRINT WAITING |

| PRINT ORDER |
|---|
| REPRINTING OF NO. 3 |
| No.5 |

FIG.12E

| | |
|---|---|
| No.1 | PRINTING FINISH |
| No.2 | PRINTING FINISH |
| No.3 | PRINTING FINISH REPRINTING FINISH |
| No.4 | PRINTING FINISH |
| No.5 | PRINT WAITING |

| PRINT ORDER |
|---|
| No.5 |

PRINTING APPARARUS AND PRINTING CONTROL METHOD

BACKGROUND OF THE INVENTION

1. Field of the Invention

The present invention relates to a printing apparatus and a printing control method, and specifically to a printing apparatus and a printing control method that can perform printing on both surfaces of a continuous sheet.

2. Description of the Related Art

Conventionally a continuous sheet such as a roll paper is produced by establishing connections between sheets. The continuous sheet has a splice portion caused by this connection process, and the splice portion is generally inappropriate for printing. In addition, also in a case where damages exist on the sheet, the damage becomes a spot inappropriate for printing. In general, in a case of using the continuous sheet on which these unique portions that are inappropriate for printing exist, the control of avoiding the unique portion to perform printing is performed. This control allows the continuous sheet on which the unique portion exists to be used for printing and reduces the waste of the sheet. It should be noted that in the present specification, the unique portion means a portion where a characteristic of a sheet partially differs, such as a blot, a hole and a damage in a sheet, a splice portion between sheets, a fracture and a break in a sheet, foreign object mixing to a sheet, a change in color, unevenness in thickness and a dirt in a sheet, and the like.

Japanese Patent Laid-Open No. 2011-240493 discloses a technique that in a case of performing printing on both surfaces of the continuous sheet on which the unique portion exists, when the unique portion is detected during performing the printing on one side surface (front surface) of the sheet, the printing onto the detected spot is avoided and the printing avoided image is printed on the next printable area. In addition, in Japanese Patent Laid-Open No. 2011-240493, the printing is controlled such that printing to a region of other side surface corresponding to the spot of the one side surface in which the unique portion is detected is likewise avoided and the printing avoided image is printed in the next region. This control allows the printing to be performed on both of the one side surface and the other side surface of the sheet while avoiding the spot where the unique portion exists, thus preventing generation of defect printing.

However, Japanese Patent Laid-Open No. 2011-240493 does not describe at all a case where the unique portion exists on the other side surface of the sheet. That is, according to Japanese Patent Laid-Open No. 2011-240493, detection of the unique portion is not performed in the printing onto the other side surface of the sheet and, as described above, the printing onto the area corresponding to the unique portion detection on the one side surface is only avoided. Therefore the printing is performed as it is even if the unique portion exists on the other side surface. In this case, there occurs a problem that a quality of the printed image is degraded due to the existence of the unique portion. In addition, in a case of a set of images associated on the front and other side surfaces as in the case of bookbinding of a photo book or the like, the printed image on the one side surface corresponding to the other side surface on which the unique portion exists becomes wasteful.

SUMMARY OF THE INVENTION

An object of the present invention is to provide a method which in a case where a unique portion of a sheet is detected at the time of performing printing on a second surface of the sheet as a backside of a first surface thereof, appropriately deals with detection of the unique portion.

In a first aspect of the present invention, there is provided a printing apparatus comprising: a control unit configured to control printing of images so that a plurality of images are printed on a first surface of a continuous sheet and then a plurality of images are printed on a second surface which is a backside of the first surface; and a detecting unit configured to detect a unique portion unsuitable for image printing that exists on the continuous sheet, wherein in a case where the detecting unit detects the unique portion when printing on the second surface, the control unit controls so as not to perform printing on an area including the unique portion, and so as to add a print job for printing of an image on the second surface that has been scheduled to be printed on the area and for printing of an image that has been already printed on the first surface corresponding to the area.

In a second aspect of the present invention, there is provided a printing control method comprising: controlling printing of images so that a plurality of images are printed on a first surface of a continuous sheet and then a plurality of images are printed on a second surface which is a backside of the first surface; and in a case where a unique portion existing on the continuous sheet, the portion being unsuitable for image printing, is detected when printing on the second surface, controlling printing of an image so as not to perform printing on an area including the unique portion, and so as to add a print job for printing of an image on the second surface that has been scheduled to be printed on the area and for printing of an image that has been already printed on the first surface corresponding to the area.

According to the above-mentioned configuration, in duplex printing, in a case where the unique portion is detected at the time of performing the printing on the second surface of the sheet, it is possible to perform the reprinting of images on both side surfaces corresponding to the area where the unique portion is detected.

Further features of the present invention will become apparent from the following description of exemplary embodiments (with reference to the attached drawings).

BRIEF DESCRIPTION OF THE DRAWINGS

FIGS. 11A to 11C are diagrams each showing states of print jobs that are displayed on a display unit;

FIGS. 12A to 12E are diagrams each showing the order of jobs to be reprinted;

DESCRIPTION OF THE EMBODIMENTS

Hereinafter, embodiments of the present invention will be explained in detail with reference to the accompanying drawings.

Hereinafter, a printing apparatus using an inkjet method will be explained. The printing apparatus of the present embodiment is a line printer that uses an elongated, continued sheet (continuous print sheet longer than a length of a print unit (called one page or a unit image) to be repeated in a conveying direction), and is adapted for both of simplex printing and duplex printing. For example, this printing apparatus is appropriate for a field of printing a great number of sheets in a printing laboratory or the like. It should be noted that in the present specification, even if a plurality of small images, characters and blank spaces are mixed within a region of one print unit (one page), all of these elements included within this region are collectively called a single unit image. That is, the unit image means a single print unit (one page) in a case of sequentially printing a plurality of pages on a continuous sheet. It should be noted that there are some cases where instead of using the unit image, an image is simply used as the address term. A length of the unit image differs corresponding to a size of an image to be printed. For example, in a photo of an L-size, a length of the unit image in the sheet conveying direction is 135 mm, and in a photo of A4-size, the length thereof in the sheet conveying direction is 297 mm. The present invention can widely be applied to a printing apparatus in which ink is used to require the drying, such as a printer, a printer complex machine, a copier, a facsimile apparatus, manufacturing apparatuses for various devices, and the like.

Figure 1:
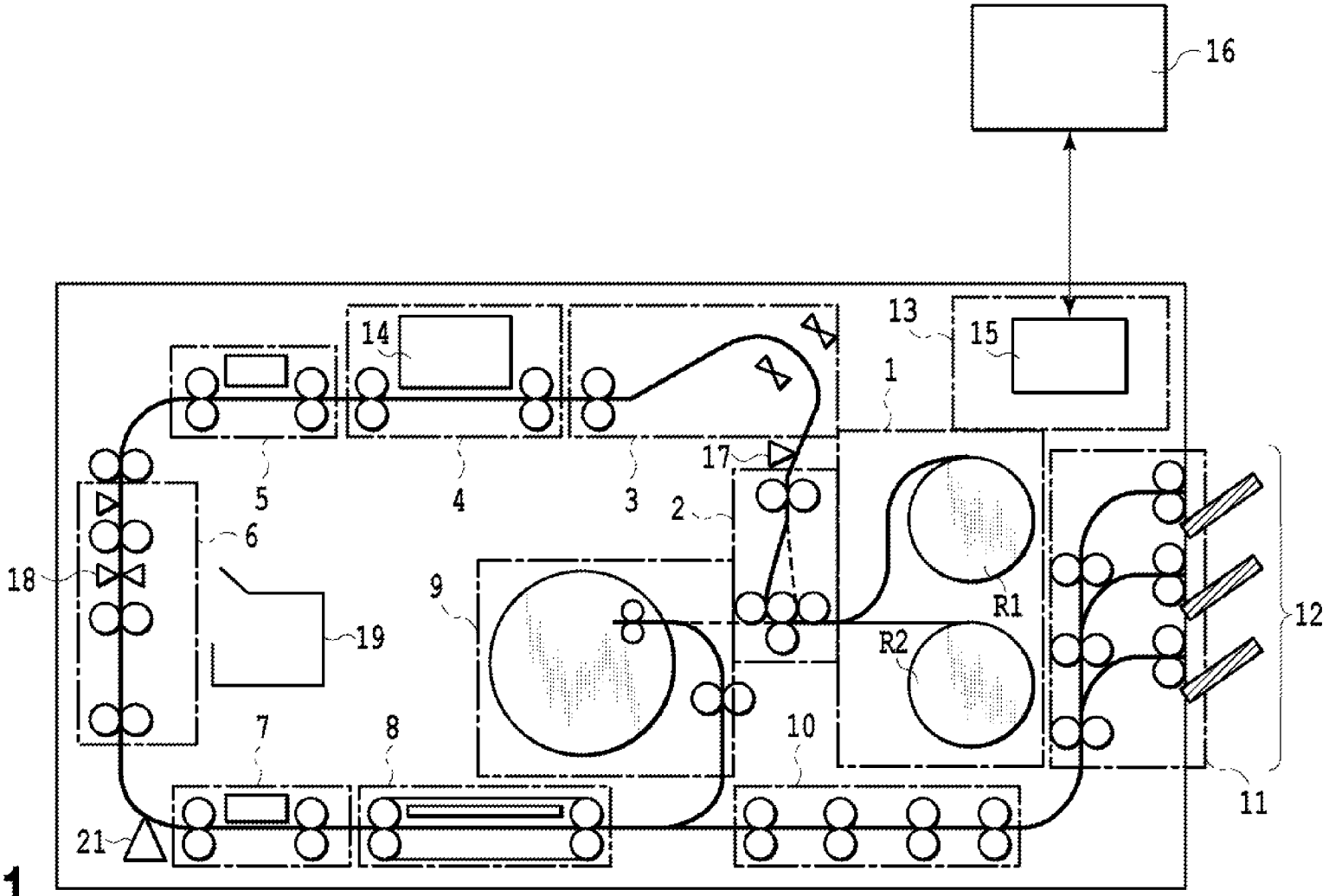
FIG. 1 is a cross sectional view showing a schematic configuration of a printing apparatus according to an embodiment of the present invention.

FIG. 1 is a cross sectional view showing the schematic configuration of a printing apparatus in a first present embodiment of the present invention. The printing apparatus in the present embodiment is configured in such a manner that use of a sheet wound in a rolling shape allows printing to be performed onto both surfaces of a first surface (one side surface) of the sheet and a second surface (other side surface) as the backside of the first surface thereof. The printing apparatus comprises schematically respective units of a sheet supply unit 1, a decal unit 2, an oblique movement correcting unit 3, a printing unit 4, an inspection unit 5, a cutter unit 6, an information printing unit 7, a drying unit 8, a reverse unit 9, a discharge conveying unit 10, a sorting unit 11, a discharge unit 12 and a control unit 13. The discharge unit 12 includes the sorting unit 11, and is a unit configured to perform discharge processing. The sheet is conveyed along a sheet conveying path shown in a solid line in the figure by a conveying mechanism composed of paired rollers and a belt, and the processing is executed onto the sheet by each unit. It should be noted that in any position of the sheet conveying path, a side closer to the sheet supply unit 1 is called "upstream", and the reverse side is called "downstream".

The sheet supply unit 1 is a unit for holding and supplying the continuous sheet wound in a roll shape. The sheet supply unit 1 is configured in such a manner as to be capable of accommodating two rolls R1 and R2 and selectively extract the sheet for supply. It should be noted that the number of the rolls which can be accommodated in the sheet supply unit 1 is not limited to two, but one, three or more rolls may be accommodated therein. In addition, as long as the sheet is a continuous sheet, it is not limited to the sheet wound in a rolling shape. For example, the continuous sheet may be configured such that the continuous sheet having perforation for each unit length is folded back for each perforation to be stacked, which is accommodated in the sheet supply unit 1.

The continuous sheet to be used herein has a splice portion jointed by a tape or paste at one or more locations and at a random position. The splice portion becomes a unique portion in image printing. The unique portion, other than the splice portion, includes, as described above, a blot, a hole and a damage in a sheet, a fracture and a break in a sheet, foreign object mixing into a sheet, and a change in color and unevenness in thickness, dirt and the like in a sheet. These unique portions are areas of unsuitable for image printing where a print quality is degraded in a case where the printing of an image is performed thereon. As described later, the control of avoiding the printing onto this unique portion is performed.

The decal unit 2 is a unit for reducing a curl of the sheet supplied from the sheet supply unit 1. In the decal unit 2, two pinch rollers are used to one drive roller to curve and pass the sheet therebetween in such a manner as to generate a curl in the reverse direction to the sheet, thus applying a decal force on the sheet to reduce the curl of the sheet. A unique portion detection sensor 17 is provided near the outlet port of the decal unit 2, and detects the unique portion on the one side surface and the other side surface of the continuous sheet that passes through decal unit 2 and is conveyed. The oblique movement correcting unit 3 is a unit for correcting an oblique movement (inclination to an original forward direction) of the sheet having passed the decal unit 2. The oblique movement of the sheet is corrected by pressing a sheet end portion as a base side onto a guide member. In the oblique movement correcting unit 3, a loop is formed in the sheet to be conveyed.

The printing unit 4 performs a printing process onto the conveyed sheet by using a print head 14 from above to form an image on the sheet. The printing unit 4 is also provided with a plurality of conveying rollers for conveying the sheet. The print head 14 is in the form of a line type print head in which an inkjet type of nozzle rows is formed in a range covering the maximum width of the sheet estimated to be used. The print head 14 is configured such that a plurality of print heads is arranged in parallel along the conveying direction. The present embodiment includes seven print heads corresponding to seven colors of C (cyan), M (magenta), Y (yellow), LC (light cyan), LM (light magenta), G (gray), and K (black). It should be noted that the color number and the number of the print heads respectively are not limited to seven. In regard to the inkjet type, a type using a heater element, a type using a piezo element, a type using an electrostatic element, and a type using an MEMS element and the like may be adopted. The inks of the respective colors are supplied respectively to the print heads 14 through respective ink tubes from respective ink tanks.

The inspection unit 5 is a unit for optically reading an inspection pattern or an image that is printed on the sheet in the printing unit 4 by a scanner to inspect a state of the nozzle in the print head, a sheet conveying state, an image position, and the like, thus determining whether or not the image is correctively printed thereon. The scanner includes a CCD image sensor or a CMOS image sensor. The cutter unit 6 is a unit provided with a mechanical cutter 18 for cutting the printed sheet to a predetermined length. The cutter unit 6 is further provided with a cut mark sensor for optically detecting a cut mark that is printed on the sheet, and a plurality of conveying rollers for feeding out the sheet to the next process.

A garbage box 19 is provided near the cutter unit 6. The garbage box 19 accommodates small sheet pieces that are generated by cutting the sheet in the cutter unit 6 and are discharged as garbage. The cutter unit 6 is provided with a sorting mechanism on whether the cut sheet is discharged to the garbage box 19 or is transferred to the original conveying path.

The information printing unit 7 is a unit for printing print information (unique information) such as a serial number and a date of the printing in the non-printing area of the cut sheet. The printing is performed by printing characters and codes with an inkjet method, a thermal transfer method or the like. A sensor 21 is provided upstream of the information printing unit 7 and downstream of the cutter unit 6 for detecting a front end edge of the cut sheet. The timing for printing the information in the information printing unit 7 is controlled based upon the detected timing of the sensor 21. The drying unit 8 is a unit for heating the sheet that is printed in the printing unit 4 to dry the ink, which is applied to the sheet, in a short time. Inside the drying unit 8, an ink-applied face of the sheet is dried by providing a hot air to the sheet passing therein, at least from the bottom side. It should be noted that the drying method is not limited to the method for providing the hot air to the sheet surface, but may be a method for irradiating an electromagnetic wave (ultraviolet ray or infrared ray) with the sheet surface.

The sheet conveying path from the sheet supply unit 1 to the drying unit 8 as described above is called a first path. The first path has a U-turn shape between the printing unit 4 and the drying unit 8, and the cutter unit 6 is positioned along the way of the U-turn shape.

The reverse unit 9 is a unit for, at duplex printing, temporarily winding the continuous sheet on which the one side surface printing is completed to reverse the sheet from the one side surface to the other side surface. The reverse unit 9 is provided along the way of a loop path (referred to as a second path) from the drying unit 8 to the printing unit 4 via the decal unit 2 for once more supplying the sheet having passed the drying unit 8 to the printing unit 4. The reverse unit 9 is provided with a winding drum rotating for winding the sheet. The continuous sheet in which the printing on the one side surface is completed and which is not cut is temporarily wound by the winding drum. When the winding of the sheet is finished, the winding drum rotates reversely to feed out the wound sheet in a reverse direction to that at the above winding time, which is supplied to the decal unit 2 and is conveyed to the printing unit 4. This sheet is reversed from the one side surface to the other side surface, and therefore printing can be performed on the other side surface in the printing unit 4. When the sheet supply unit 1 is regarded as a first sheet supply unit, the reverse unit 9 may be regarded as a second sheet supply unit. A more specific operation of the both-side printing will be described later.

The discharge conveying unit 10 is a unit for conveying the sheet which was cut in the cutter unit 6 and was dried in the drying unit 8 to be delivered to the sorter unit 11. The discharge conveying unit 10 is provided in a path (called a third path) different from the second path in which the reverse unit 9 is provided. For selectively guiding the sheet conveyed from the first path to either one of the second path or the third path, a path-switching mechanism having a movable flapper is provided in a branch position of the path (referred to as "discharge branch position"). The discharge unit 12 including the sorting unit 11 is provided in the side portion of the sheet supply unit 1 and in the terminal of the third path. The sorter unit 11 is a unit for sorting the printed sheets for each group of the sheets as needed. The sorted sheets are discharged to a plurality of trays provided in the discharge unit 12. In this way, the third path has the layout of passing under the sheet supply unit 1 and discharging the sheet to an opposite side to the printing unit 4 or the drying unit 8 to sandwich the sheet supply unit 1.

As described above, the sheet supply unit 1 to the drying unit 8 are provided in order in the first path. The forward side of the drying unit 8 is branched into the second path and the third path, and the reverse unit 9 is provided along the way of the second path. The forward side of the reverse unit 9 merges with the first path. The discharge unit 12 is provided in the terminal of the third path.

The control unit 13 is a unit configured to manage control of each unit in the entire printing apparatus. The control unit 13 includes a controller provided with a CPU, a memory and various control units, an external interface, and an operation portion 15 with which a user performs input/output. An operation of the printing apparatus is controlled based upon a command from the controller or from the host device 16 such as a host computer connected through the external interface to the controller.

Figure 2:
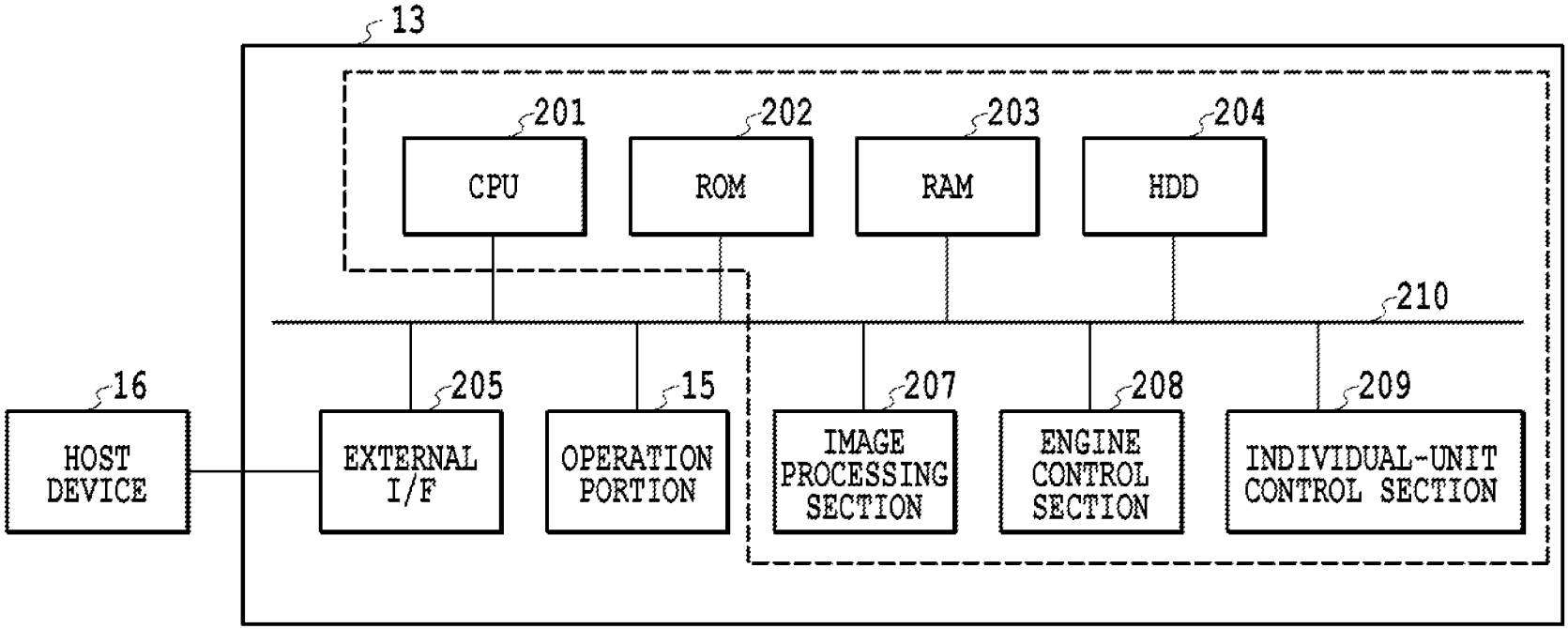
FIG. 2 is a block diagram showing the configuration of a control unit in the printing apparatus.

FIG. 2 is a block diagram showing the configuration of the control unit 13 shown in FIG. 1. The controller (a range bounded by a broken line) accommodated in the control unit 13 comprises a CPU 201, a ROM 202, a RAM 203, an HDD 204, an image processing section 207, an engine control section 208, and an individual-unit control section 209. The CPU 201 (central processor unit) integrally controls operations of the respective units in the printing apparatus. The ROM 202 stores therein programs including the processing to be described later after FIG. 3 for execution of the CPU 201 and fixed data required for various operations of the printing apparatus. The RAM 203 is used as a work area of the CPU 201, is used as a temporal storage area of various reception data and stores various setting data therein. The HDD 204 (hard disc) can store therein or read out therefrom programs for execution of the CPU 201, print data, and setting information required for the various operations of the printing apparatus. The operation portion 15 is an input/output interface with a user, and includes input components of hard keys, a touch panel and the like, and output components of a display showing information, an audio generator, and the like.

The unit that is required to execute high-speed data processing is provided with an exclusive processing unit. The image processing section 207 executes image processing of print data that is processed in the printing apparatus 20. A color space (for example, YCbCr) of the input image data is converted into a standard RGB color space (for example, sRGB). In addition, various kinds of the image processing such as resolution conversion, image analysis, image correction and the like are executed to the image data as needed. The print data obtained by the above-mentioned kinds of the image processing is stored in the RAM 203 or the HDD 204. The engine control section 208 performs drive control of the print head 14 in the print unit 4 in accordance with print data based upon a control command received from the CPU 201 or the like. The engine control section 208 further performs control of a conveying mechanism of each unit in the printing apparatus. The individual-unit control section 209 is a sub controller for individually controlling the respective units of the sheet supply unit 1, the unique portion detection sensor 17, the decal unit 2, the oblique movement correcting unit 3, the inspection unit 5, the cutter unit 6, the information printing unit 7, the drying unit 8, the reverse unit 9, the discharge conveying unit 10, the sorting unit 11, and the discharge unit 12. The operations of the respective units are controlled based upon commands from the CPU 201 by the individual-unit control section 209. The external interface 205 is an interface (I/F) for connecting the controller to the host device 16, and is a local I/F or a network I/F. The components as described above are connected through a system bus 210.

The host device 16 is a device that serves as a supply source of image data for causing the printing apparatus to perform printing. The host device 16 may be a general-purpose or exclusive computer, or an exclusive image instrument such as an image capture, a digital camera, a photo storage or the like, which has an image reading unit. In a case where the host device 16 is configured of a computer, an operational system, application software for generating image data, and a printer driver for the printing apparatus are installed in the memory accommodated in the computer. It should be noted that it is not necessarily required to realize all of the above-mentioned kinds of the processing by software, and a part or all thereof may be realized by hardware.

Next, a basic operation of the printing apparatus at printing according to the present embodiment will be explained. Since a one-side printing mode and a both-side printing mode differ in the printing operation, an explanation will be made of each of the printing operations.

In the one-side printing mode, the printing is performed in the printing unit 4 on a one side surface (first surface) of the sheet that is supplied from the sheet supply unit 1 and is processed in each of the decal unit 2 and the oblique movement correcting unit 3 in the printing unit 4. Images each having a predetermined unit length (unit image) in the conveying direction are sequentially printed on the elongated continuous sheet to form a plurality of the images on the first surface. The printed sheet is fed through the inspection unit 5 and is cut for each unit image in the cutter unit 6. In the cut sheet, the print information is printed on the other side surface of the sheet in the information printing unit 7 as needed. The cut sheets are conveyed one by one to the drying unit 8 for drying. Afterwards the cut sheets are sequentially discharged to and loaded on the discharge unit 12 in the sorter unit 11 via the discharge conveying unit 10. On the other hand, the sheet that is left in a side of the printing unit 4 by the cutting of the final unit image is fed back to the sheet supply unit 1 to be wound by roll R1 or roll R2. In this way, in the one-side printing, the sheet goes through the first path and the third path to be processed, and does not go through the second path.

On the other hand, at the both-side printing mode, the other side surface (second surface) printing sequence is performed following the one side surface (first surface) printing sequence. In the one side surface printing sequence performed at first, the operations of the respective units from the sheet supply unit 1 to the inspection unit 5 are the same as the operations at the one-side printing as described above. Therefore a plurality of images can be printed on the first surface. The cut operation is not performed to the continuous sheet in the cutter unit 6, and the continuous sheet is conveyed to the drying unit 8 as it is. The sheet is, after drying the ink on the one side surface of the sheet in the drying unit 8, guided not in the path (third path) in a side of the discharge conveying unit 10, but is guided in the path (second path) in a side of the reverse unit 9. In the second path, the sheet is wound on the winding drum of the reverse unit 9 rotating in the forward direction (in a counter-clockwise direction in the figure). When the printing onto the one side surface of the continuous sheet to be scheduled is all completed in the printing unit 4, a rear end of the continuous sheet in the print region is cut in the cutter unit 6. The continuous sheet downstream of the cut position in the conveying direction (printed side) is all wound to the sheet rear end (cut position) in the reverse unit 9 via the drying unit 8. On the other hand, at the same time with the winding of the continuous sheet in the reverse unit 9, the continuous sheet that is left upstream of the cut position in the conveying direction (in a side of the printing unit 4) is fed back to the sheet supply unit 1 such that the sheet front end (cut position) does not remain in the decal unit 2, and the sheet is wound in roll R1 or roll R2 therein. The feeding-back (back feed) operation allows avoidance of collision of the continuous sheet with the sheet that will be again supplied in the following other side surface printing sequence.

The printing operation is switched to the other side surface printing sequence following the above-mentioned one side surface printing sequence. The winding drum of the reverse unit 9 rotates in a reverse direction (clockwise direction in the figure) to a direction at the winding time. An end portion of the wound sheet (the sheet rear end at the winding is a sheet front end at feeding-out) is fed into the decal unit 2 along the path in a broken line of the figure. In the decal unit 2, correction of the curl provided by the winding drum is performed. That is, the decal unit 2 is provided between the sheet supply unit 1 and the printing unit 4 in the first path, and between the reverse unit 9 and the printing unit 4 in the second path, which is a common unit serving as the decal in any path. The sheet reversed from the one side surface to the other side surface is fed to the printing unit 4 via the oblique movement correcting unit 3, wherein printing is performed on the other side surface of the sheet. The sheet in which the plurality of the images are printed on the second surface goes through the inspection unit 5, and is cut in the cutter unit 6 for each predetermined unit length (length of image) preset. Since the printing is performed on both the surfaces of the cut sheet, printing onto the cut sheet is not performed in the information printing unit 7. The cut sheets are conveyed one by one to the drying unit 8, go through the discharge conveying unit 10, and are sequentially discharged to and loaded on the discharge unit 12 in the sorter unit 11. In this way, at the both-side printing the sheet goes through the first path, the second path, the first path, and the third path in that order to be processed.

Figure 3:
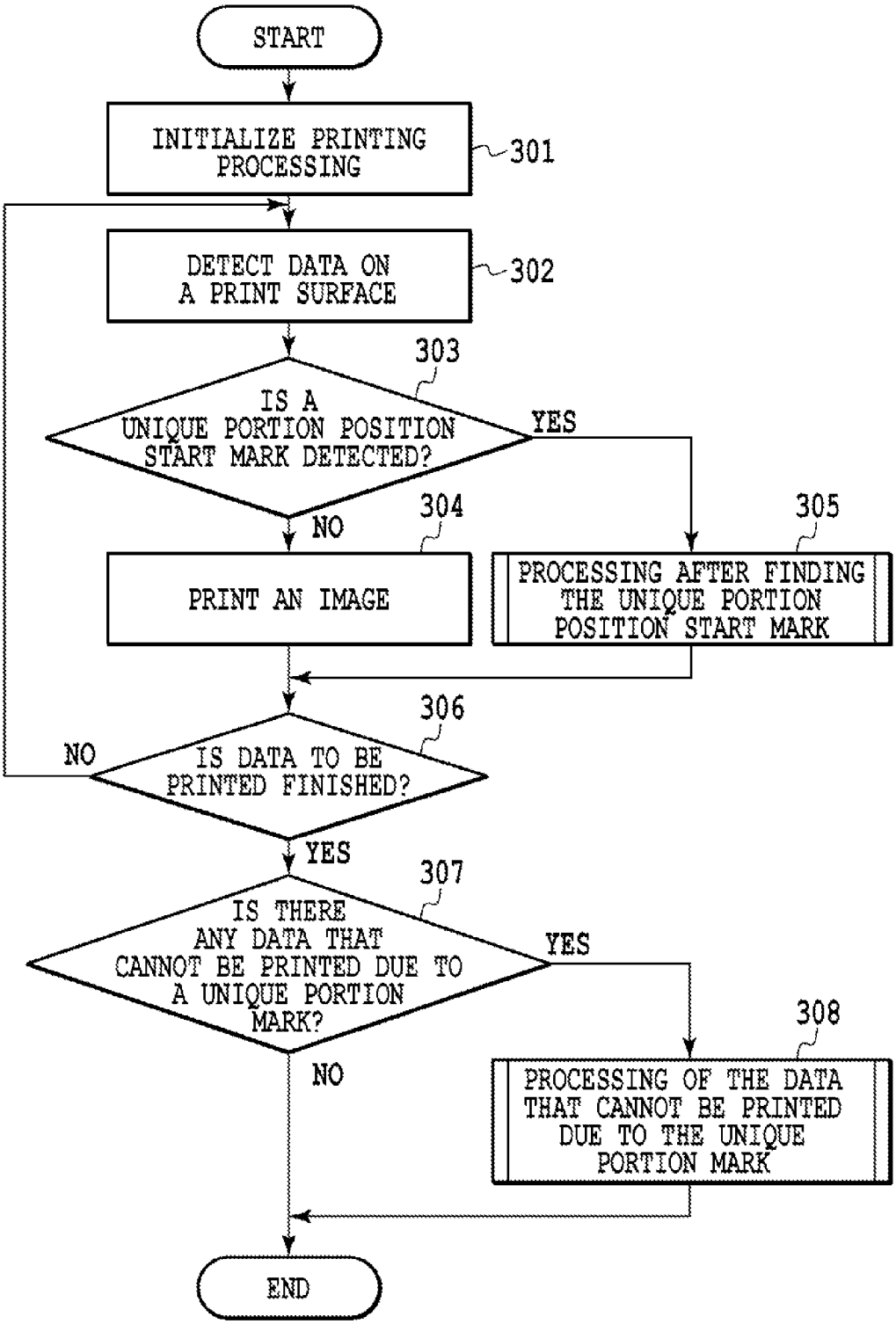
FIG. 3 is a flow chart showing the processing when a unique portion in a sheet is detected.

FIG. 3 is a flow chart showing a printing process according to the first embodiment of the present invention, and particularly shows the processing at the time the unique portion on a sheet is detected. In the printing process of the present embodiment, basically the printing on the one side surface (first surface) of a sheet and the printing on the other side surface (second surface) thereof are performed in the order of the first surface and the second surface. In a case where a unique portion mark is detected at the time of performing the printing on the other side surface of the sheet, a unique portion mark region is specified, and the reprinting control is performed such that the image that is scheduled to be printed on that unique portion area is reprinted.

Figure 15:
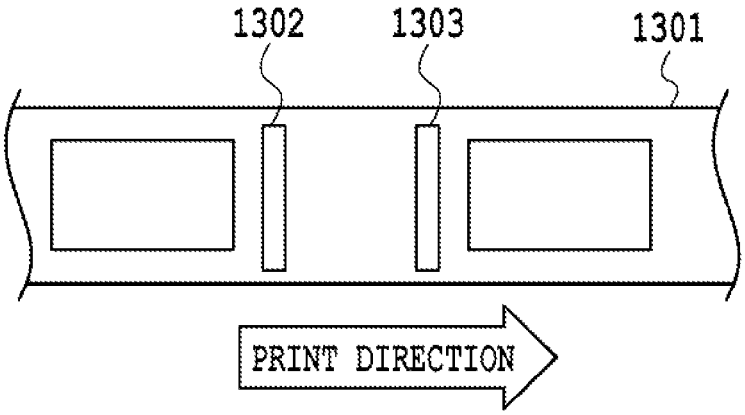
FIG. 15 is a diagram explaining a unique portion mark.

FIG. 15 is a diagram explaining the unique portion mark in the present embodiment. As shown in FIG. 15, a unique portion position start mark 1302 and a unique portion position end mark 1303 are in advance printed on a continuous sheet 1301. More specifically, these marks indicate that a unique portion exists in an area between the marks, and indicate a start and an end of the area in a printing direction (direction in reverse to a direction where the sheet is conveyed in a printing operation). Here, "unique portion" means, as described above, a part in which a characteristic of a sheet partially differs, such as a blot, a hole and a damage in a sheet, a connecting part between sheets, a fracture and a break in a sheet, foreign object mixing into a sheet, and a change in color and unevenness in thickness, dirt and the like in a sheet. In the present embodiment, these unique portions are regarded as areas where a print quality is degraded, and the printing onto the unique portion is avoided.

It should be noted that the present embodiment is provided with the form of in advance printing the unique portion mark on a sheet and detecting the unique portion mark, but is not limited thereto. The form of the present embodiment is only required to read in the sheet by the apparatus and to be resultantly able to distinguish that a part of the sheet is a unique portion area. The unique portion position start mark and the unique portion position end mark are only required to be provided with the form of being able to read in information of the sheet for specifying the unique portion area, for example by adding information to the unique portion mark or setting a constant section from the unique portion mark to the unique portion area. Further, the detection of the unique portion is not limited to the form of reading in the unique portion by a sensor or the like. The form may be configured such that the unique portion is in advance detected in the produced sheet, the detection result is stored in a memory medium such as a magnetic memory medium together with information on which part of the sheet the unique portion exists, and the memory medium is provided together with the detected sheet. In addition, the unique portion can be detected from the memory medium at the time of using the sheet.

By referring to FIG. 3, when the printing is started, at step 301 the printing processing is first initialized, that is, an engine control section 208 and the like before a printing operation is performed are initialized. Next, at step 302 supply of the continuous sheet is made from the sheet supply unit 1, and detecting processing of the information in advance printed in the sheet is performed by the unique portion detection sensor 17 near the outlet port of the decal unit 2. Next, at step 303 the information detected at step 302 is analyzed to determine whether or not there exists a unique portion position start mark. In a case where the unique portion position start mark is not detected, at step 304 an image is printed on the continuous sheet in the printing unit 4. On the other hand, when at step 303 the unique portion position start mark is detected, the process goes to step 305. At step 305 the processing after the unique portion position start mark is detected is executed. In the processing after detected, as the details will be described later in FIG. 4, the printing of the image to be printed on the print surface in regard to the unique portion position start mark is skipped. In addition, in a case where the unique portion position start mark is detected in the printing on the other side surface of the sheet, the reprinting is separately performed together with the above skip.

At step 306 it is determined whether or not the data to be printed exists. In a case where the data to be printed still exists, the processing after step 302 is repeated. In a case where the processing is the processing after it is determined that the unique portion position start mark exists in the printing on the one side surface of the sheet (step 303), the image skipped in the processing after step 302 (in a case where the unique portion position start mark is further not detected) is next printed. It should be noted that the skipped image may be finally printed.

When at step 306 it is determined that the data to be printed does not exist, at step 307 it is determined whether or not the image that can not be printed exists by detecting the unique portion position start mark. In a case where the images are printed as print jobs to be scheduled, the present processing ends. In a case where it is determined that the image that can not be printed exists by detecting the unique portion mark, at step 308, as the details will be described later in FIG. 8, the reprinting processing of the data that could not be printed by the detection of the unique portion mark is executed.

Figure 4:
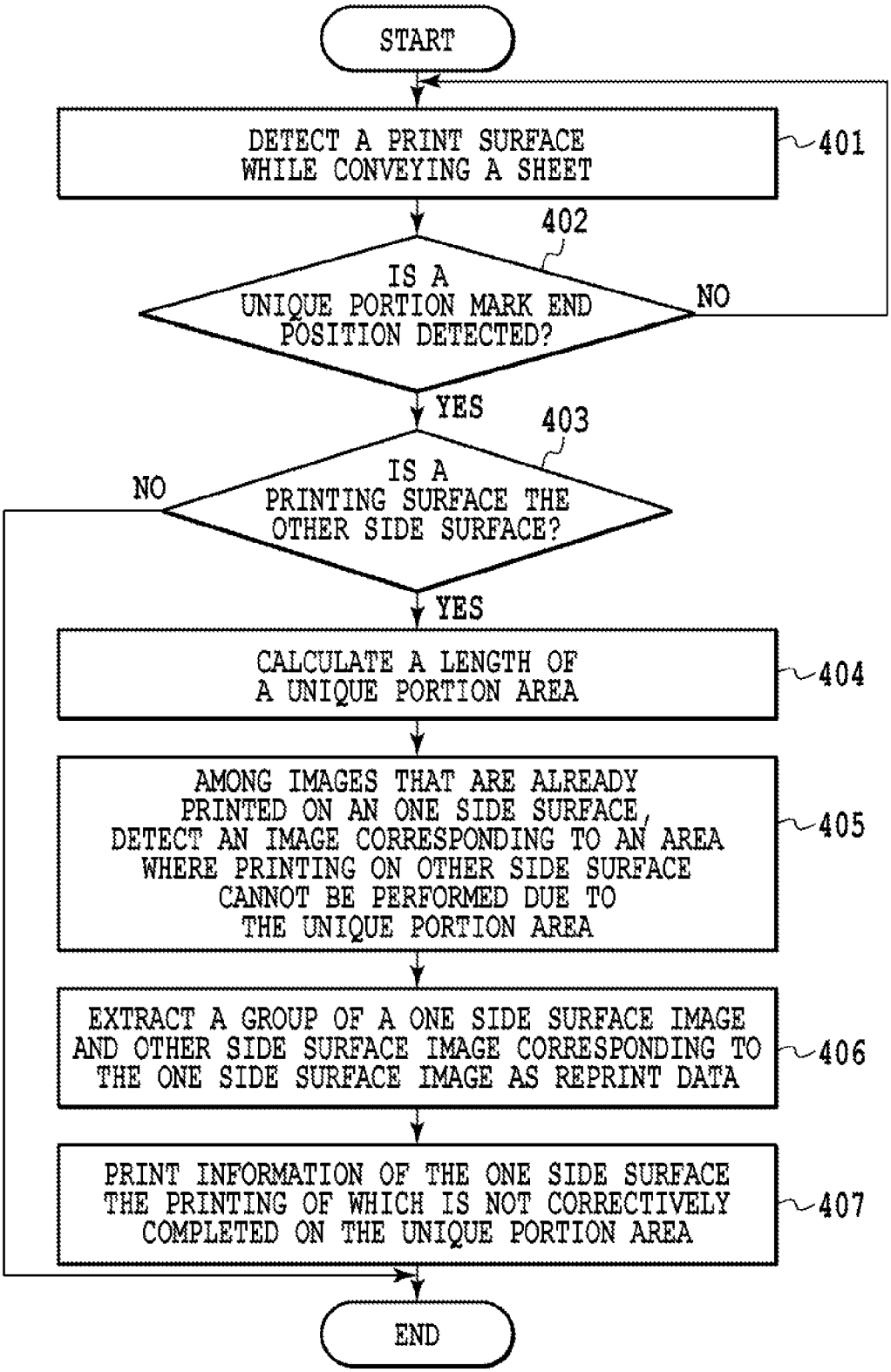
FIG. 4 is a flow chart showing the details of the processing after a unique portion position start mark is detected.

FIG. 4 is a flow chart showing the details of the processing after finding the unique portion position start mark at the step 305.

First at step 401 the unique portion position start mark is detected, and after that, the image printing is skipped and the sheet surface is scanned by a sensor while conveying the sheet. Then, at step 402 it is determined whether or not the unique portion position end mark is detected. When the unique portion position end mark is detected, at step 403 the surface on which the printing is presently performed is confirmed. In a case where the print surface is the one side surface of the sheet, the present processing ends.

On the other hand, when at step 403 it is determined that the present print surface is the other side surface of the sheet, at step 404 a length of the unique portion area is calculated. In the present embodiment, the length of the unique portion area is found by calculating an interval between positions where the unique portion position start mark and the unique portion position end mark are detected. Next, among the images that are already printed in the printing onto the one side surface of the sheet, the image of the one side surface of the sheet corresponding to the unique portion area calculated at step 404 is detected.

FIG. 5, FIGS. 6A and 6B and FIG. 7 are diagrams each explaining an example where in a case where the unique portion area exists on the other side surface of the sheet, an image on the sheet one side surface corresponding to the unique portion area is detected. It should be noted that in these figures, identical elements are referred to as identical reference numerals, and the repetition of the explanation is omitted.

Figure 5:
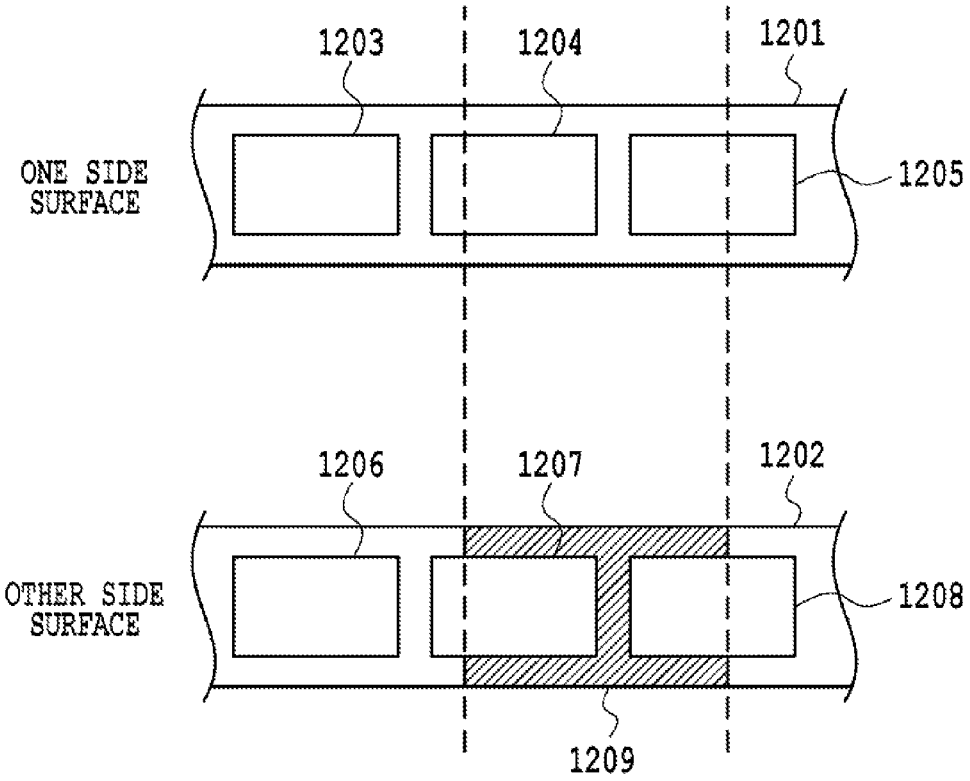
FIG. 5 is diagrams for explaining a form of detection of an image on a one side surface of a sheet.

FIG. 5 shows an example where in a case where the unique portion area exists on the other side surface of the sheet, the printed image exists on the one side surface corresponding to the unique portion area. In FIG. 5, a reference numeral 1201 denotes the one side surface of the continuous sheet on which images are printed, a reference numeral 1202 denotes the other side surface of the continuous sheet that is the same as the sheet of the one side surface 1201. In addition, reference numerals 1203 to 1205 denote images printed on the one side surface 1201 of the sheet, and reference numerals 1206 to 1208 denote images to be printed on the other side surface corresponding to the images 1203 to 1205 on the one side surface (images on the first surface) respectively. In addition, a reference numeral 1209 denotes the unique portion area on the other side surface of the sheet.

In the example shown in FIG. 5, since the images 1207 and 1208 to be printed on the other side surface are included in the unique portion area 1209, these images become objects of the reprinting. In addition, in regard to the images 1204 and 1205 that are already printed on the one side surface corresponding respectively to the images 1207 and 1208, if the images 1207 and 1208 corresponding to the unique portion area of the other side surface are not printed, the association between one side surface image and other side surface image is spoiled. Therefore the images 1204 and 1205 become objects of the reprinting. That is, at step 405 the images 1204 and 1205 are detected as images to be reprinted on the one side surface.

Figure 6A:
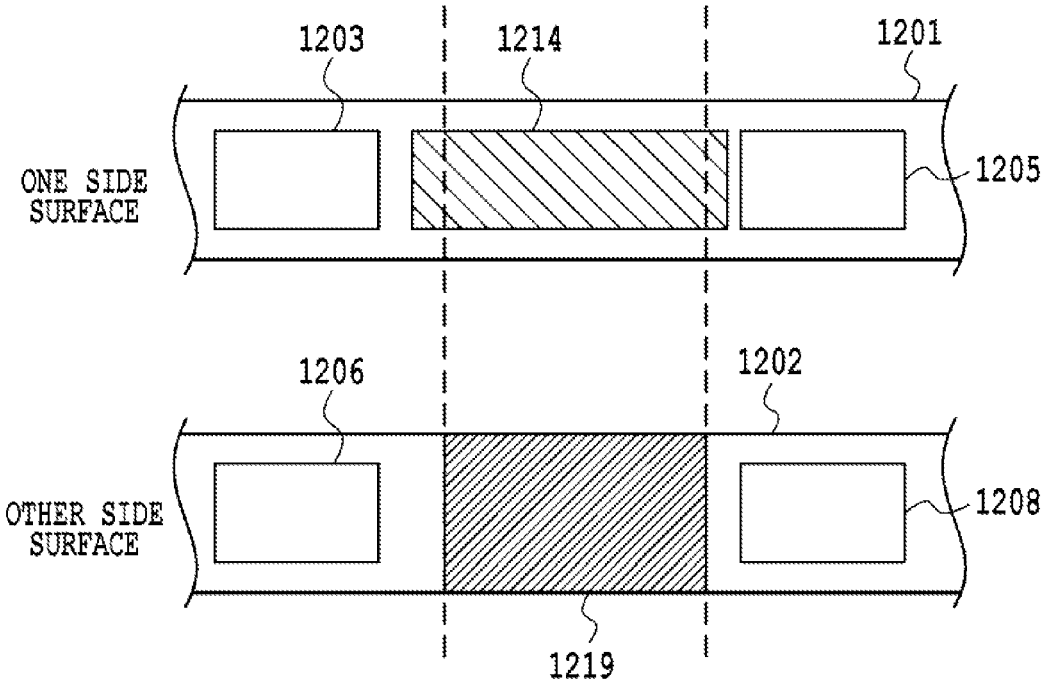
FIGS. 6A and 6B are diagrams each explaining a form of detection of an image on the one side surface of the sheet.

FIG. 6A shows an example where in a case where it is detected that the unique portion area exists on the other side surface of the sheet, the data printed on the corresponding one side surface is data that does not require the reprinting. For example, data for maintenance is included in this example. In FIG. 6A, a reference numeral 1214 denotes the maintenance data printed on the one side surface of the sheet. The maintenance data is data that is not required particularly as the print result. In addition, a reference numeral 1219 denotes the unique portion area on the other side surface of the sheet. In this example, the data that is already printed on the one side surface of the sheet corresponding to the unique portion area 1219 is the maintenance data 1214, and is not an object of reprinting. Accordingly, in this case, the processing of steps 405 to 407 is not executed, and the processing shown in FIG. 4 ends.

Figure 6B:
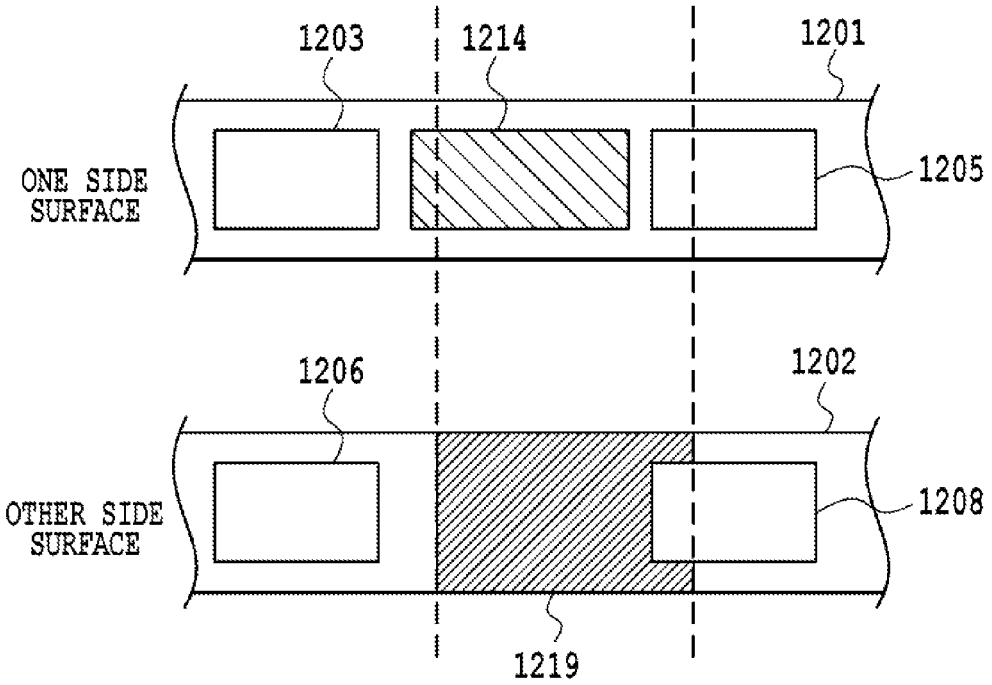

FIG. 6B shows an example where in a case where it is detected that the unique portion area exists on the other side surface of the sheet, the data printed on the corresponding one side surface is both of image data that does not require the reprinting and image data that requires the reprinting. As shown in FIG. 6B, the image 1208 to be printed on the other side surface is included in the unique portion area 1219 on the other side surface of the sheet. In addition, a part of each of the maintenance data 1214 and the image 1205 is printed in a region of the one side surface of the sheet corresponding to the unique portion area 1219 on the other side surface of the sheet. In this case, the maintenance data 1214 does not become an object of the reprinting. Therefore only a set of the image 1205 on the one side surface and the image 1208 on the other side surface becomes an object of the reprinting, and at steps 405 and 406, this set of the images is detected.

Figure 7:
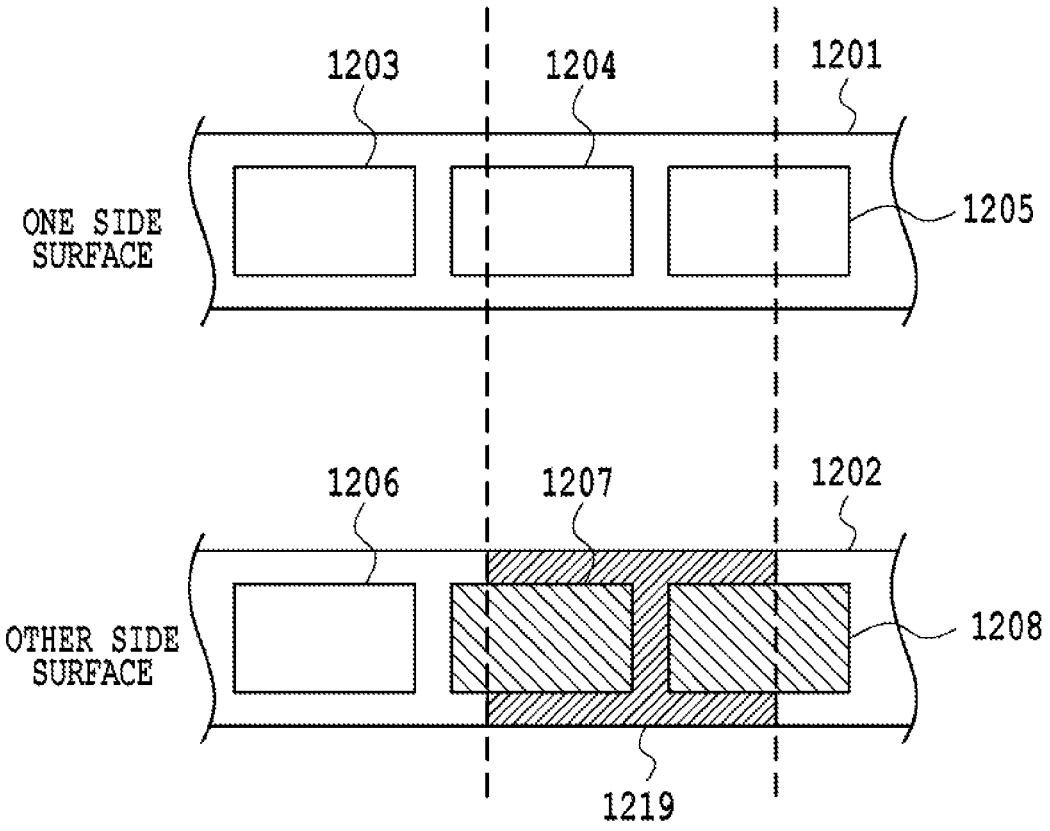
FIG. 7 is diagrams for explaining a form of detection of an image on the one side surface of the sheet.

FIG. 7 shows an example of a case where in a case where it is detected that the unique portion area exists on the other side surface of the sheet, images of the other side surface (images of the second surface) to be printed are printed in that area. As shown in FIG. 7, since the images 1207 and 1208 to be printed on the other side surface are included in the unique portion area 1209, these images become objects of the reprinting. In addition, the images 1204 and 1205 corresponding to the above images 1207 and 1208 become objects of the reprinting. In this case, in the present example, the images 1207 and 1208 are printed without avoiding the printing of the images 1207 and 1208. The information that these images are to be reprinted is added to the printed image 1207 and 1208. In the present embodiment, in the following step 407 the information of the image to be printed on the one side surface is printed as such information, but as long as that information can be recognized as the information of the reprinting, any information may be adopted. In this example, as described above, at step 405 the corresponding images 1204 and 1205 on the one side surface of the sheet are detected.

By again referring to FIG. 4, at next step 406 a group of the images on the one side surface detected at step 405 and the corresponding images on the other side surface is extracted as reprint data, which is stored in a predetermined memory. Next, at step 407 the information in regard to the image on the one side surface among the extracted images is printed in the unique portion area. In the present embodiment, the printing is performed by using the information printing unit 7.

It should be noted that in the present embodiment, the unique portion position start mark and the unique portion position end mark are read in, and the unique portion area is defined based thereupon, but the method for determining the unique portion area, which includes the method for reading in the unique portion mark to determine that a constant section is regarded as the unique portion area, is not limited to that of the present embodiment. In addition, at step 407 the printing is performed in the information printing unit 7, but as long as a printing mechanism that is able to perform the printing onto the sheet is adopted, the printing, which includes on which side of the one side surface and the other side surface the printing is performed, may be performed by any printing mechanism.

Figure 8:
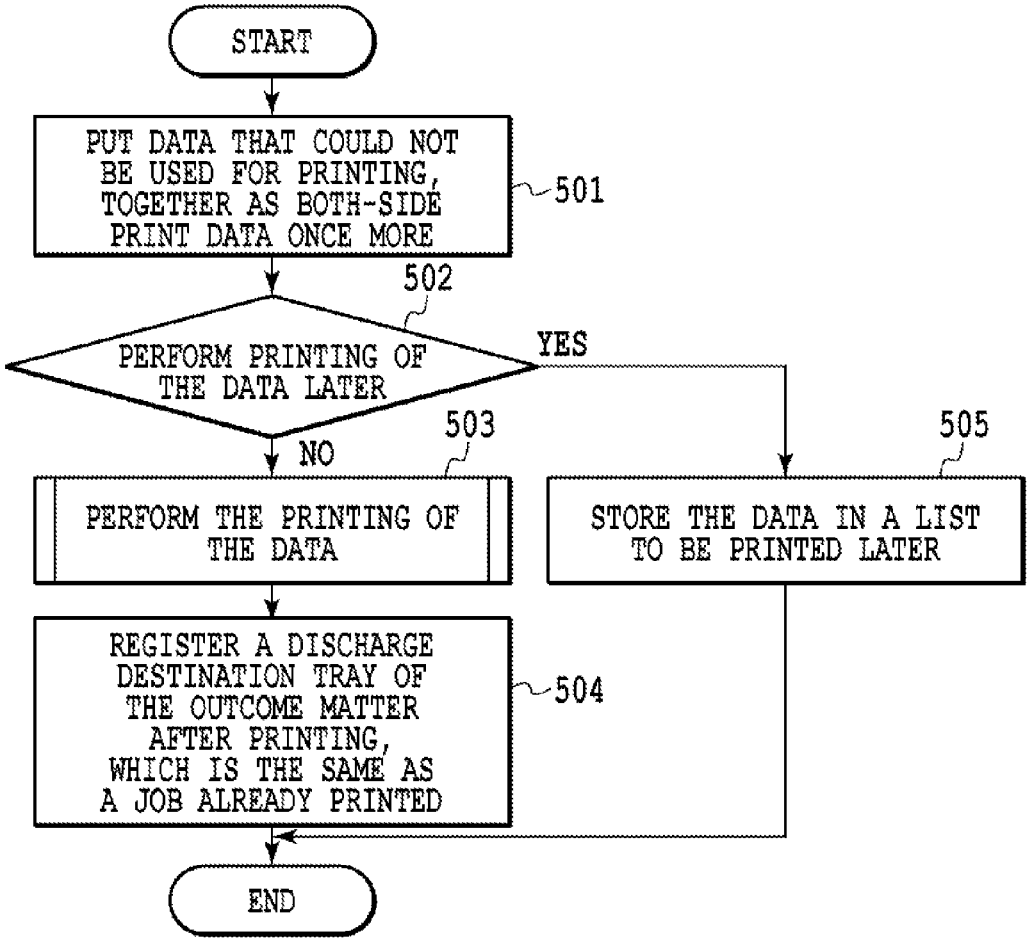
FIG. 8 is a flow chart showing the details of reprinting processing.

FIG. 8 is a flow chart showing the details of the reprinting processing of step 308 shown in FIG. 3.

First, at step 501 the image data that was extracted at step 406 in FIG. 4 and could not be printed due to the existence of the unique portion is once more put together as the both-side print data. Next, at step 502 it is determined whether or not the printing of the image data is performed later. Whether or not the printing of the image data is performed later can be set using the operation portion 15. If it is determined that the printing of the image data is performed later, at step 505 the reprint data is stored in a list for performing the printing later. In this case, the printing is again performed on both of the corresponding surfaces of the sheet by the processing shown in FIG. 3.

On the other hand, if it is determined that the printing is not performed later, at step 503 the printing is performed. In this case, the printing is performed on both of the corresponding surfaces of the sheet by the processing shown in FIG. 3. Next, at step 504 the tray discharge destination of the outcome matter after printed that is the same as that of the job that is already printed is registered. By doing so, the output matter that is determined to be reprinted can be also output to the same tray, and as a result, which job the reprinting is performed is found out by a loading state of the tray. There is performed the sheet loading control for loading the reprinted sheet in the tray in which the sheet, on which the image of each of the one side surface and the other side surface that is printed before and after the image of each of the one side surface and the other side surface in regard to the reprinting is printed, is loaded.

Figure 9:
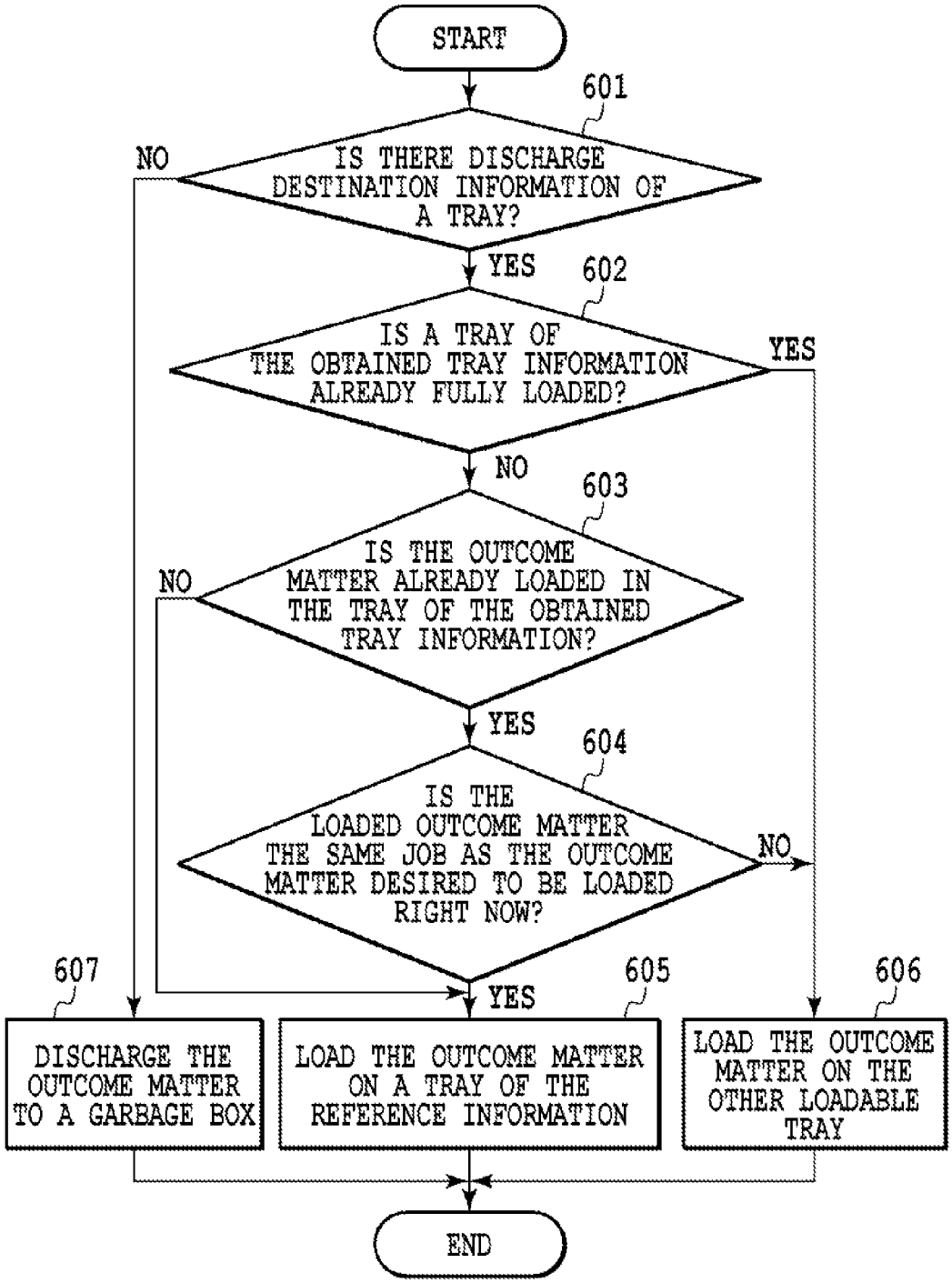
FIG. 9 is a flow chart showing discharge control to a tray.

FIG. 9 is a flow chart showing the discharge control to the tray according to the first embodiment of the present invention. By the present processing, the tray to which the printed sheet for each job is discharged can be controlled. In addition, in the present embodiment, a printed matter (outcome matter) on which the unique portion mark is detected and the reprinting is performed is controlled to be able to be discharged to the same tray as the relating printed matter.

First, at step 601 it is confirmed whether or not the discharge destination information of the tray exists. In a case where there exists no discharge destination information of the tray, at step 607 the printed matter is discharged to the garbage box, and the present processing ends. On the other hand, when at step 601 it is determined that there exists the discharge destination information of the tray, at step 602 it is determined whether or not the tray of the obtained tray information is fully loaded. In a case where the tray is fully loaded, at step 606 the printed matter is discharged to the other loadable tray.

In a case where at step 602 it is determined that the tray is not fully loaded, it is determined whether or not the outcome matter is already loaded in the tray of the obtained tray information. In a case where the outcome matter is not loaded, at step 605 the outcome matter is loaded in the tray of the reference information. On the other hand, in a case where the outcome matter is already loaded in the tray of the obtained tray information, at step 604 it is determined whether or not the loaded outcome matter has the same job as the job that will be discharged. In a case where it is determined that the loaded outcome matter is different from the job of the printed matter that will be discharged, the process goes to step 606. On the other hand, in a case where it is determined that the loaded outcome matter has the same job as the job that will be discharged, at step 605 the outcome matter is loaded in the tray of the reference information.

In a case where the outcome matter reprinted by detecting the unique portion mark has the same job, the outcome matter can be discharged to the tray of the same job by performing the above-mentioned discharge control.

Figure 10:
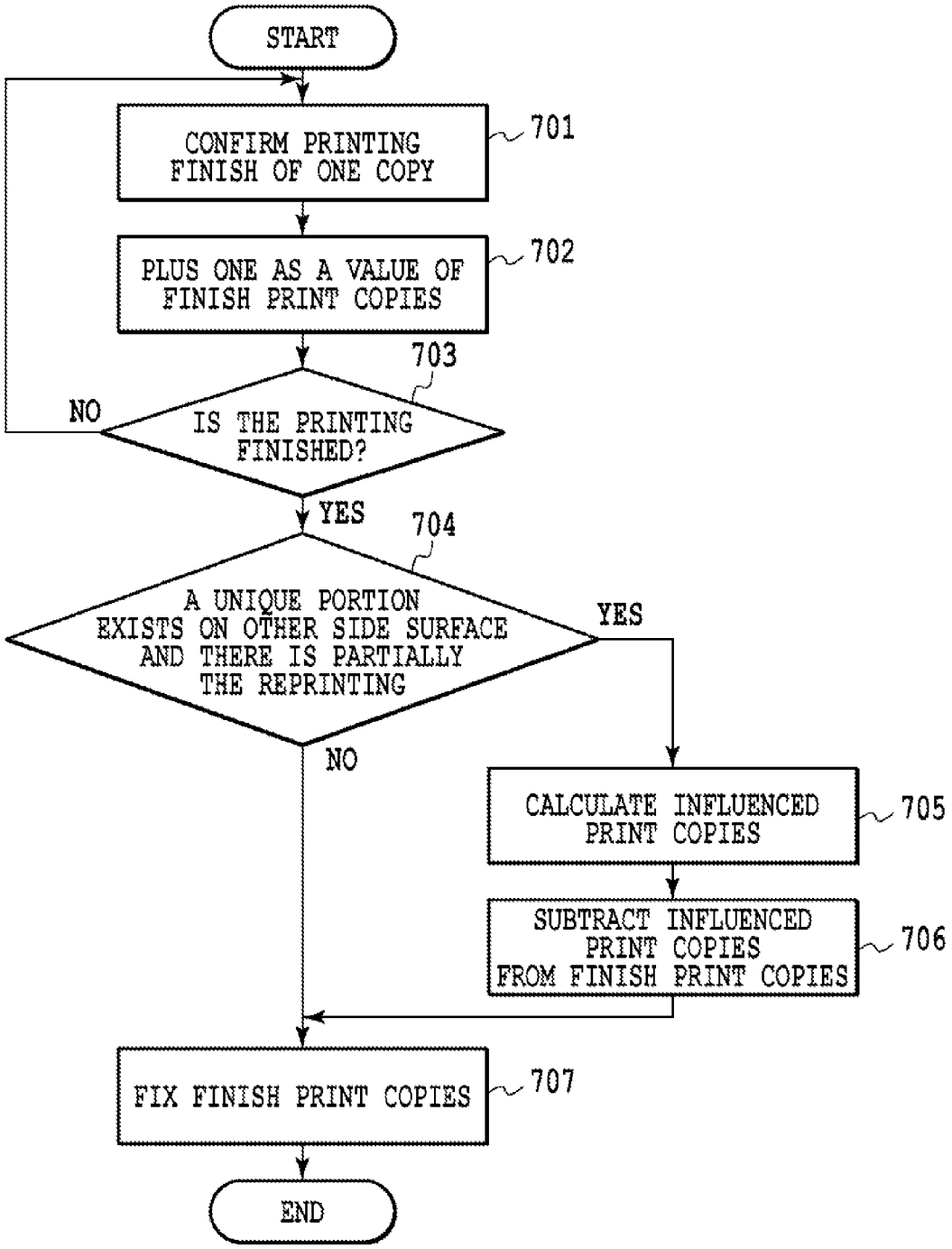
FIG. 10 is a flow chart showing counting processing of print copies.

FIG. 10 is a flow chart showing the counting processing of print copies according to the first embodiment in the present invention. The present processing is, while executing the printing processing shown in FIG. 3, the processing for separately performing the counting of print copies. First at step 701 the printing finish of one copy is confirmed. Next, at step 702 a value of the finish print copies is increased by one. In addition, at step 703 it is determined whether or not the printing is finished. In a case where the printing is not finished, the processing after step 701 is repeated. On the other hand, in a case where at step 703 it is determined that the printing is finished, at step 704 it is determined whether or not the unique portion exists on the other side surface and there is partially the reprinting. In a case where it is determined that there is no reprinting, at step 707 the finish print copies are fixed.

On the other hand, as explained in FIG. 3, in a case where at step 704 it is determined that there is the reprinting, at step 705 the print copies associated with it are calculated. Specifically the number of the print copies in regard to which the printing is not yet finished is calculated. Next, at step 706 the print copies calculated at step 705 is subtracted from the finish print copies. In addition, at step 707 the finish print copies are fixed.

FIGS. 11A to 11C are diagrams each showing a state of print jobs displayed on the display unit of the operation portion 15 according to the present embodiment. A unit to be printed is defined as a job, and the attribute is expressed in a list table for each job. In addition, a status of the job is displayed in the right column. FIGS. 11A to 11C show a state in which the status of each of the jobs 1 to 8 is changing.

In an example shown in the figure, in a case where the reprinting occurs in regard to the job No. 4 as described above, "there is the reprinting" is displayed in the status as shown in FIG. 11B. In addition, as shown in FIG. 11C, the status of the reprinting thereafter is displayed. When the reprinting is already performed, it can be confirmed that each of the printing and the reprinting is already performed. In this way, when the reprinting is performed, the status can be confirmed.

FIGS. 12A to 12E are diagrams each showing the order of jobs to be reprinted. FIGS. 12A to 12E show a change of the reprinting print job in a time series.

First, as shown in FIG. 12A, the printing is already performed in Job No. 1 and Job No. 2, and is in the middle of being performed in Job No. 3. In addition, the printing performance of jobs after No. 1 and No. 2 is in the order of No. 3, No. 4 and No. 5. Next, as shown in FIG. 12B, it is shown that the printing is already performed in Job No. 3, but there is the reprinting. Therefore the reprinting job of Job No. 3 is again put in the print order. This order is the reprint order of Job No. 4, Job No. 5 and Job No. 3. At this time, as shown in FIG. 12C, since Job No. 4 is already in the middle of being performed, the reprinting of Job No. 3 is performed in the order after Job. 4, and the Job No. 5 is replaced by Job No. 3. In addition, as shown in FIG. 12D, since Job No. 4 is already printed, next the reprinting of Job No. 3 is performed. FIG. 12E shows that the reprinting of Job No. 3 is finished. In this way, in regard to the content for the reprinting, the printing is performed considering the print order separately.

Figure 13:
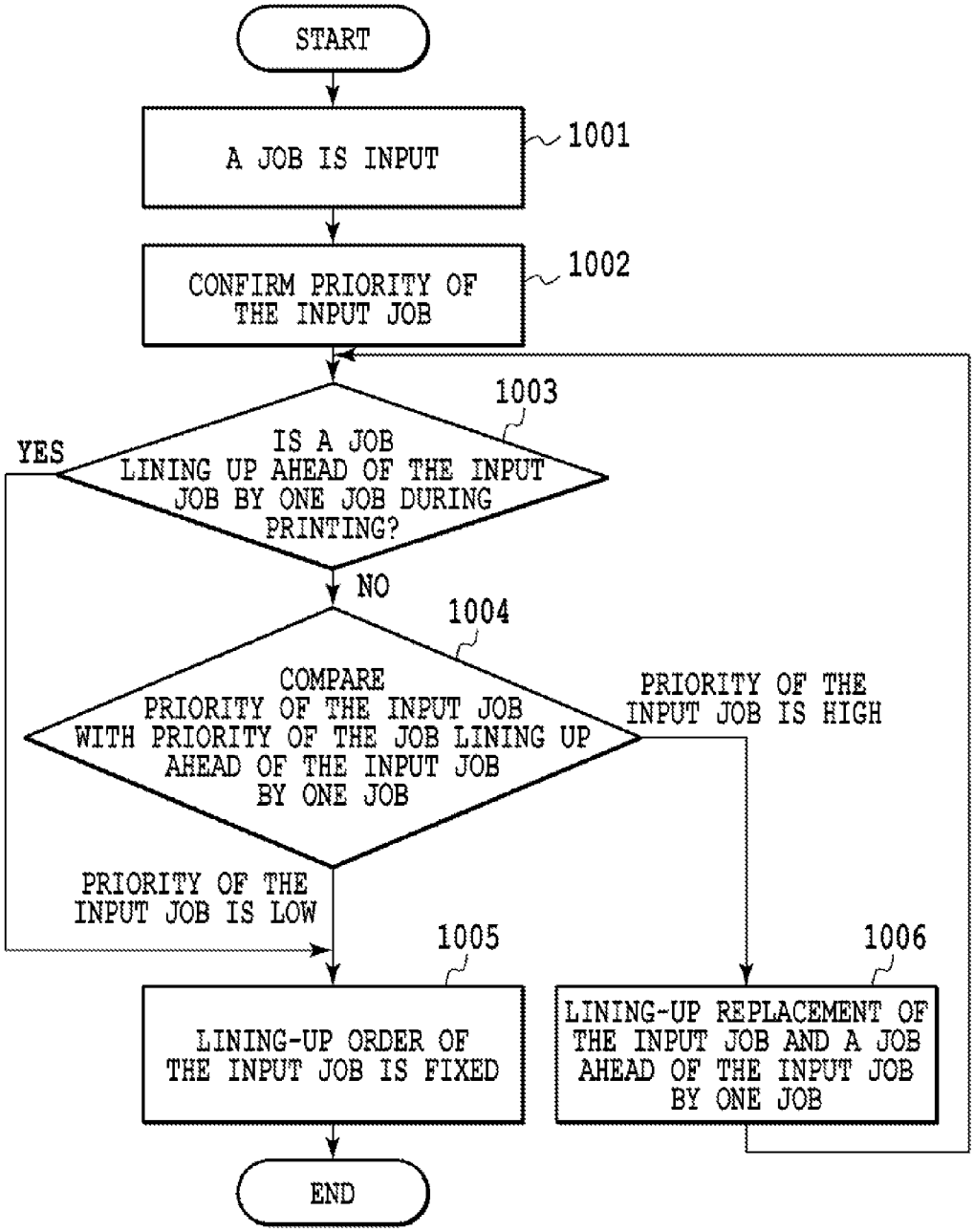
FIG. 13 is a flow chart showing the processing for defining a print order of printing jobs.

FIG. 13 is a flow chart showing the processing for defining the print order of printing jobs, and particularly shows the processing for determining the print order of the reprinting job shown in FIGS. 12B to 12D.

First, at step 1001 it is confirmed whether or not a job is input. In a case where the job is input, at step 1002 priority of the input job is confirmed. At step 1003 it is determined whether or not a job that lines up ahead of the input job by one job is in the middle of being performed. In a case where the job is in the middle of being performed, at step 1005 the lining-up order of the input job is fixed. On the other hand, when at step 1003 it is determined that the input job is not in the middle of being performed, at step 1004 the priority of the input job is compared with that of the job lining up ahead of the input job by one job. In a case where the input job has a higher priority, at step 1006 the input job and the job ahead of it by one job are replaced in the print order, and the process again goes to step 1003. In this case, since the lining-up replacement is previously made at step 1006, the present input job lines up ahead by one job from previously. Therefore at step 1003 the present input job results in being compared with the job ahead of the job by one job previously compared at step 1003, in regard to the priority. In this way, as a result of the processes of step 1003, step 1004 and step 1006, the print order of the input job can be earlier according to the priority. FIGS. 12A to 12E show an example of five jobs, and the number of jobs is not limited thereto without mentioning.

On the other hand, at step 1004 in a case where it is determined that the priority of the input job is low/the same, at step 1005 the order of the input job is fixed.

Figure 14:
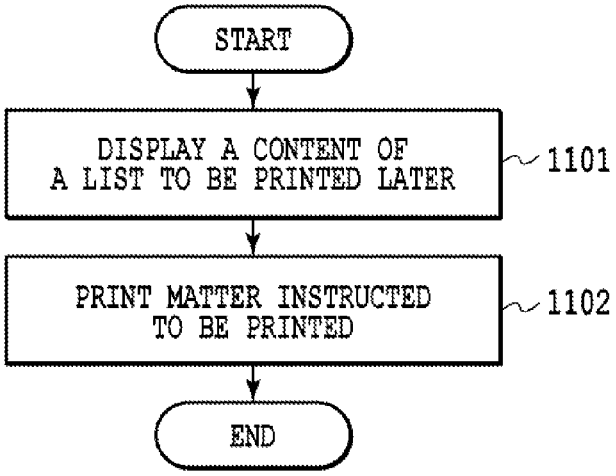
FIG. 14 is a flow chart showing the processing for performing reprinting together.

FIG. 14 is a flow chart showing the processing for performing the reprinting together according to the present embodiment. First, at step 1101 the content of the list that is printed later is displayed. In addition, at step 1102 jobs that are instructed to be printed are printed. The processing of these jobs is executed in response to an input operation of a user in the operation portion 15.

As described above, in a case where the existence of the unique portion on the other side surface of the continuous sheet is detected at the other side surface printing at the time of performing both-side printing on the continuous sheet, the image data on the other side surface that cannot be printed due to the unique portion mark and the image data on the one side surface corresponding thereto are stored in a memory. Then, the image data automatically becomes reprinting data as the next print data. That is, when the unique portion is detected at the printing onto the second surface, a set of the image of the second surface to be printed in an area including the unique portion and the image that is already printed on the first surface corresponding to the above image is reprinted.

The present invention can be also realized by executing the following processing. That is, the processing is executed such that the software (program) for realizing the function of the above-mentioned embodiment is supplied to a system or an apparatus via a network or various memory mediums, and a computer (CPU, MPU or the like) of the system or the apparatus reads out the program to execute the above-mentioned embodiment. In addition, the program may be executed by one computer or by a cooperation of a plurality of computers. In addition, the above-mentioned kinds of the processing all are not necessarily executed by the software, but a part or all of them may be executed by hardware.

The present invention is not limited to the above-mentioned embodiment, but can encompass various modifications (including an application to other embodiments, a combination with other embodiments, and the like) based upon the subject matter of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-169451, filed Jul. 31, 2012 hereby incorporated by reference herein in its entirety.

What is claimed is:

1. A printing apparatus comprising:

a control unit configured to control printing of images so that a plurality of images are printed on a first surface of a continuous sheet and then a plurality of images are printed on a second surface of the continuous sheet which is a backside of the first surface; and a specifying unit configured to specify on the continuous sheet a print unsuitable area including unique portion, which is unsuitable for image printing, wherein in a case where the specifying unit specifies the print unsuitable area when printing on the second surface, the control unit controls the printing of images so as to print an image for the second surface that is to be printed on the print unsuitable area and so as to reprint an image that has been already printed on the first surface corresponding to the print unsuitable area.

2. The printing apparatus according to claim 1, wherein the control unit controls discharge of sheets for which printing is completed and which are cut for each image to a discharge unit among a plurality of discharge units, wherein the control unit controls discharging of a sheet so that the sheet on which the image for the second surface that is to be printed on the print unsuitable area is printed is discharged to the discharge unit, to which a sheet on which the image of a job same as the image for printing of the reprint image has been printed has been discharged, among the plurality of discharge units.

3. The printing apparatus according to claim 1, wherein the control unit changes a print schedule according to a priority of the printing of the reprint image.

4. The printing apparatus according to claim 3, wherein the control unit sets the priority to the reprint image and determines a print order for the reprint image based on the priority of the reprint image and a priority of other images.

5. The printing apparatus according to claim 1, wherein the specifying unit includes a sensor for detecting marks indicating the unique portion, the marks being formed on the continuous sheet.

6. The printing apparatus according to claim 5, wherein the marks include a start mark and an end mark, a range where the sensor detects the start mark and the end mark specified as the print unsuitable area.

7. The printing apparatus according to claim 5, wherein a range of a predetermined length measured from a position at which the sensor detects the mark is specified as the print unsuitable area.

8. The printing apparatus according to claim 1, wherein the control unit controls printing so as to perform printing of information about the image, which is printed on the first surface corresponding to the print unsuitable area, on the print unsuitable area including the unique portion.

9. The printing apparatus according to claim 1, wherein the control unit controls printing of the reprint image so as to print the reprint image next to an image in printing.

10. The printing apparatus according to claim 1, wherein the control unit controls the printing of images so as to reprint a set of images at least a part of each of which overlaps a region on the first surface of the continuous, the region corresponding to the print unsuitable area specified by the specifying unit.

11. The printing apparatus according to claim 1, wherein the control unit controls the printing of images so as not to print a maintenance data in a case where the maintenance data is printed on a region of the first surface of the continuous, the region corresponding to the print unsuitable area specified by the specifying unit.

12. The printing apparatus according to claim 1, further comprising a print unit configured to print an image.

13. A printing control method comprising:

controlling printing of images so that a plurality of images are printed on a first surface of a continuous sheet and then a plurality of images are printed on a second surface which is a backside of the first surface; and in a case where a print unsuitable area including a unique portion, which is unsuitable for image printing, of the continuous sheet is specified when printing on the second surface, controlling printing of an image so as to print an image for the second surface that is to be printed on the print unsuitable area and so as to reprint an image that has been already printed on the first surface corresponding to the print unsuitable area.

14. A non-transitory storage medium storing the program according to claim 13.

* * * * *